US011655675B2

(12) United States Patent
Magnussen

(10) Patent No.: US 11,655,675 B2
(45) Date of Patent: May 23, 2023

(54) LADDER ASSEMBLY FOR EQUIPMENT

(71) Applicant: Access Innovations Pty Ltd, Kingaroy (AU)

(72) Inventor: Michael William Magnussen, Kingaroy (AU)

(73) Assignee: ACCESS INNOVATIONS GLOBAL LP, Orefield, PA (US)

( * ) Notice: Subject to any disclaimer, the term of this patent is extended or adjusted under 35 U.S.C. 154(b) by 0 days.

(21) Appl. No.: 16/040,286

(22) Filed: Jul. 19, 2018

(65) Prior Publication Data

US 2018/0320443 A1 Nov. 8, 2018

Related U.S. Application Data

(63) Continuation of application No. 13/271,648, filed on Oct. 12, 2011, now abandoned.

(51) Int. Cl.
*E06C 5/36* (2006.01)
*E06C 5/04* (2006.01)

(52) U.S. Cl.
CPC . *E06C 5/36* (2013.01); *E06C 5/04* (2013.01)

(58) Field of Classification Search
CPC ..... E06C 5/00; E06C 5/06; E06C 5/08; E06C 5/10; E06C 5/12; E06C 5/14; E06C 5/02; E06C 5/04; E06C 9/06; E06C 9/08; E06C 1/34; E06C 5/36; B60R 3/02; B61D 23/02; B61D 23/025; E04F 11/04; E04F 11/06; E04F 11/062; E04F 11/068
USPC ..... 182/127, 86, 85, 97
See application file for complete search history.

(56) References Cited

U.S. PATENT DOCUMENTS 188,362 A * 3/1877 Heuermann ..... E06C 5/04 182/67.1
356,088 A * 1/1887 Barnes ..... E06C 5/04 182/67.2
693,646 A * 2/1902 Groff ..... E06C 5/04 182/66.1
1,183,707 A * 5/1916 Winegarden ..... B61D 23/02 105/430
1,614,006 A * 1/1927 Loetscher ..... E04F 11/04 182/79
1,811,709 A * 6/1931 Bessler ..... E04F 11/068 182/80
1,930,992 A * 10/1933 Bessler ..... E04F 11/04 182/80
2,577,914 A * 12/1951 Pfahl ..... E04F 11/04 182/80
2,777,737 A * 1/1957 Balogh ..... B66F 11/044 182/1

(Continued)

FOREIGN PATENT DOCUMENTS

CA 2781574 A1 * 8/2011 ..... E06C 5/04
CA 2781575 A1 * 8/2011 ..... E06C 9/08
EP 3006267 A1 * 4/2016 ..... E02F 9/0833

*Primary Examiner* — Daniel P Cahn
*Assistant Examiner* — Shiref M Mekhaeil
(74) *Attorney, Agent, or Firm* — Norris McLaughlin, P.A.

(57) ABSTRACT

The invention relates to a ladder assembly for equipment, the ladder assembly comprising a ladder pivotally mounted to a mount; an actuation mechanism that includes a drive that engages a rotational actuator, the rotational actuator operatively connected to the ladder; wherein the drive causes rotation of the rotational actuator causing the ladder to pivot about the mount.

15 Claims, 8 Drawing Sheets

(56) References Cited

U.S. PATENT DOCUMENTS 2,933,149 A * 4/1960 Lee ..... B64C 1/24 182/78
3,528,574 A * 9/1970 Denner ..... B60P 1/445 182/127
3,823,839 A * 7/1974 Petzing ..... A61G 3/0209 414/541
3,836,011 A * 9/1974 Sakamoto ..... B66C 23/705 212/292
3,957,284 A * 5/1976 Wright ..... B61D 23/02 105/445
4,094,381 A * 6/1978 Wilkerson ..... E06C 5/04 182/208
4,124,096 A * 11/1978 Dudynskyj ..... A61G 3/068 414/539
4,124,097 A * 11/1978 Hawks ..... B60P 1/4421 280/166
4,168,764 A * 9/1979 Walters ..... B63B 27/14 182/1
4,396,093 A * 8/1983 Zimmerman ..... E06C 5/04 182/2.11
4,445,659 A * 5/1984 LaChance ..... E06C 7/143 182/120
4,583,466 A * 4/1986 Reddy ..... B61D 23/02 105/443
4,909,352 A * 3/1990 McComb ..... E06C 5/02 182/127
4,971,168 A * 11/1990 Stanescu ..... B63B 27/14 182/1
5,031,723 A * 7/1991 Hooten ..... E06C 1/38 182/129
5,791,857 A * 8/1998 Ziaylek, Jr. ..... E06C 5/04 182/127
6,347,686 B1 * 2/2002 Hedley ..... B60R 3/02 182/127
6,352,135 B1 * 3/2002 Jones ..... E06C 7/143 182/120
6,764,268 B2 * 7/2004 Levi ..... B60R 9/0423 224/310
6,866,118 B1 * 3/2005 Battenberg ..... E04F 11/068 182/77
6,981,572 B2 * 1/2006 Hedley ..... B63B 27/146 182/95
7,025,174 B1 * 4/2006 Hawley ..... B60R 3/02 182/127
8,397,869 B2 * 3/2013 Tsutsumi ..... E02F 9/0833 182/127
8,579,083 B2 * 11/2013 Astor ..... E06C 1/39 182/124
9,381,605 B2 * 7/2016 Moyer ..... A47B 3/0803
9,447,637 B2 * 9/2016 Morrow ..... E04F 11/062
9,862,476 B2 * 1/2018 Chourreau ..... B64C 1/24
9,957,720 B1 * 5/2018 Brunner ..... E04F 11/04
10,486,608 B2 * 11/2019 Levi ..... A62C 33/04
10,501,021 B2 * 12/2019 Livingston ..... B60R 9/042
10,538,205 B2 * 1/2020 Iotti ..... E06C 5/04
10,654,420 B2 * 5/2020 Levi ..... B60P 3/40
2006/0076189 A1 * 4/2006 Ziaylek ..... B60R 9/0423 182/127
2007/0240936 A1 * 10/2007 Brookshire ..... E06C 7/081 182/127
2009/0038885 A1 * 2/2009 Ellement ..... E06C 5/06 280/163
2009/0149123 A1 * 6/2009 Blagg ..... F24F 11/76 454/258
2009/0166129 A1 * 7/2009 Siler ..... E04F 11/1834 182/158
2011/0038698 A1 * 2/2011 Li ..... B60P 3/14 414/479
2012/0263561 A1 * 10/2012 Li ..... B60R 9/0423 414/462
2013/0048400 A1 * 2/2013 Holdener ..... E06C 5/20 180/89.1
2013/0092474 A1 * 4/2013 Magnussen ..... E06C 5/36 182/127
2013/0319794 A1 * 12/2013 Hernandez ..... E06C 5/04 182/107
2015/0125245 A1 * 5/2015 Gallagher ..... B60R 9/042 414/462
2015/0273253 A1 * 10/2015 Lenz, Jr. ..... A62C 27/00 280/4
2021/0101534 A1 * 4/2021 Aswani ..... E06C 5/44

* cited by examiner

LADDER ASSEMBLY FOR EQUIPMENT

FIELD OF THE INVENTION

This invention relates to a ladder assembly for equipment. In particular, the invention relates to a ladder assembly for a bulldozer and therefore will be described in this context. However, it should be appreciated that ladder assembly may be used for any earthmoving equipment and vehicles such as dozers, graders, scrapers, loaders, trucks, excavators, compactors, rollers, tracked drilling units, draglines and other vehicles and units of a similar type.

BACKGROUND OF THE INVENTION

Earthmoving vehicles such as bulldozers, scrapers, graders and the like equipment are an integral part of many operations such as mines and quarries. Most earthmoving equipment that is used in mines and quarries is relatively large.

Therefore an operator cannot safely enter a cabin of the earthmoving equipment by simply climbing over the earthmoving equipment. Accordingly, a ladder is usually required to gain access to the earthmoving equipment.

Most earthmoving equipment includes a fixed ladder which provides access to the cabin. Unfortunately this fixed ladder often provides a hindrance to operation of the earthmoving equipment. The ladder can obstruct the view of an operator to parts of the earthmoving equipment. Although the earthmoving equipment is large, precision operation of the earthmoving equipment is often required and an obstructed view makes precision operation difficult.

Further, the fixed ladder can easily be destroyed during normal use of the earthmoving equipment. In quarries and mines, there is often a lack of space to maneuver the earthmoving equipment. Accordingly, a fixed ladder can easily become squashed between the earthmoving equipment and a fixed object such as a rock wall. This requires a replacement ladder at a substantial cost. However, the cost of having the earthmoving equipment which is not in operation is often even higher than the replacement cost of the ladder.

In order to address the above issues, various pivotally movable ladders have mounted to earthmoving vehicles. The ladder is typically connected to a hydraulic ram which moves the ladder from a deployment position in which an operator can utilize the ladder to access the cabin of the earthmoving equipment to a storage position in which the ladder is stored while the early moving equipment is being operated.

Although many of the ladders provide excellent access for an operator to the cabin of the earthmoving equipment, when ladder is in the deployed position, many of the ladders still are a hindrance to operation of the earthmoving equipment when located in the storage position. That is, the ladders still obstruct an operator's view and can be easily broken during operation of the earthmoving equipment.

The reference to any prior art in this specification is not, and should not be taken as, an acknowledgement or any form of suggestion that the prior art forms part of the common general knowledge.

OBJECT OF THE INVENTION

It is an object of the invention to overcome or alleviate one or more of the disclosures or provide the consumer with the useful or commercial choice.

SUMMARY OF THE INVENTION

In one form, although not necessary the only or broadest form, the invention relates to a ladder assembly for equipment, the ladder assembly comprising:

a ladder pivotally mounted to a mount:

an actuation mechanism that includes a drive that engages a rotational actuator, the rotational actuator operatively connected to the ladder;

wherein the drive causes rotation of the rotational actuator causing the ladder to pivot about the mount.

Preferably the drive is in the form of a linear actuator. The linear actuator may include a ram. The ram may be a pneumatic or hydraulic ram. The liner actuator may further include a rack which is attached to the ram.

The rotational actuator may be attached directly to the ladder. The rotational actuator may include a shaft. The shaft is normally able to be rotated. The rotation of the shaft is typically caused by movement of the linear actuator.

The shaft is typically attached to a rotational member. Preferably, the rotation member is usually directly attached the linear actuator. The rotation member may be of any form such as a lever, pulley or gear, cog and pinion. The shaft may also be directly attached to the ladder.

BRIEF DESCRIPTION OF THE DRAWINGS

An embodiment of the invention, by way of example only, will now be described with reference to the accompanying figures in which.

DETAILED DESCRIPTION OF THE PREFERRED EMBODIMENT

Figure 1:
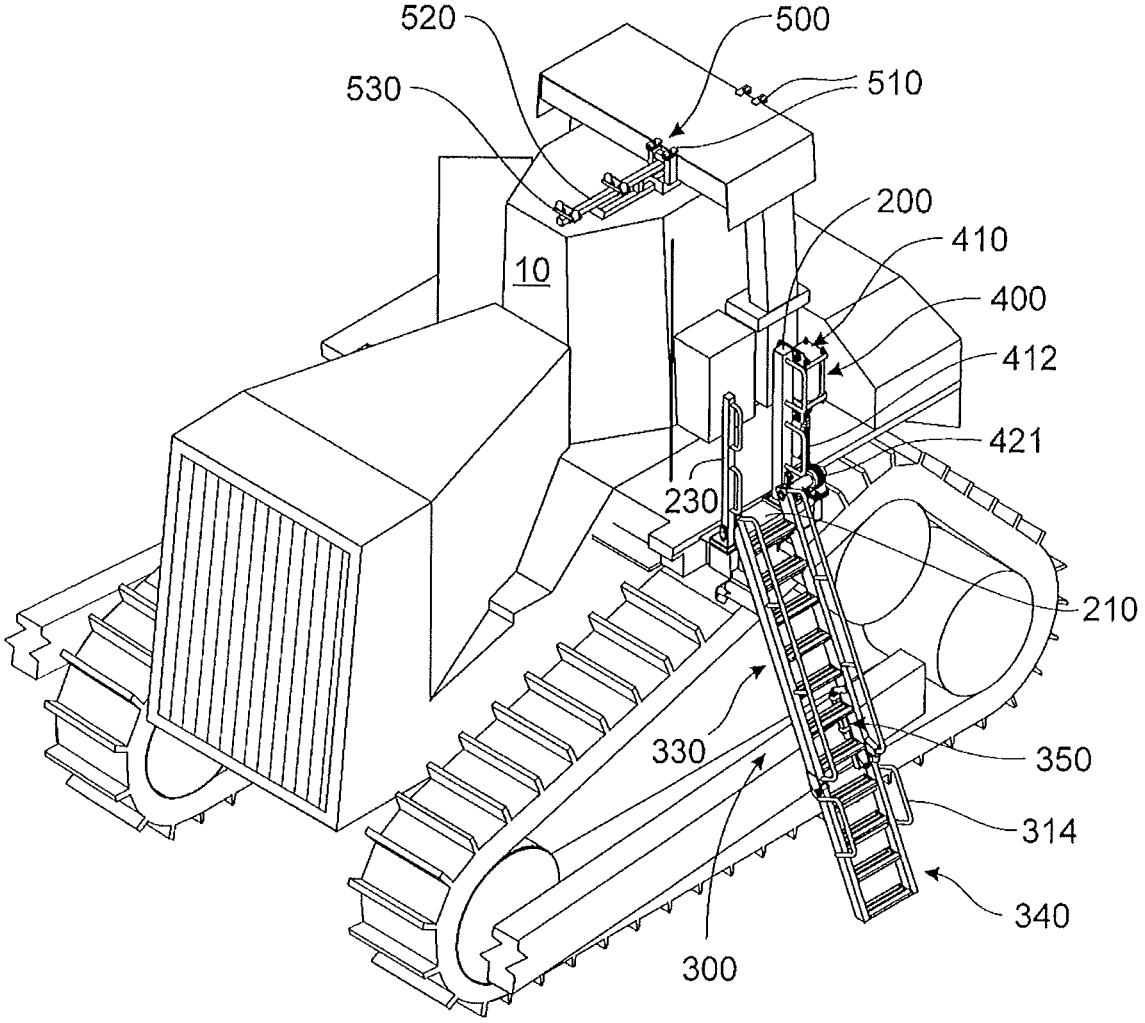
FIG. 1 is a perspective view of an bulldozer having an attached ladder assembly in a deployment position according to an embodiment of the invention.

FIGS. 1 to 4 show a ladder assembly 100 mounted to a bulldozer 10 that able to be used to allow an operator to enter cabin of the bulldozer 10 as well as operate the bulldozer 10 without physical or visual impediment. The ladder assembly 100 includes a ladder 300, a pair of handrail mounts 200, an actuation mechanism 400 and a ladder support 500.

Figure 2:
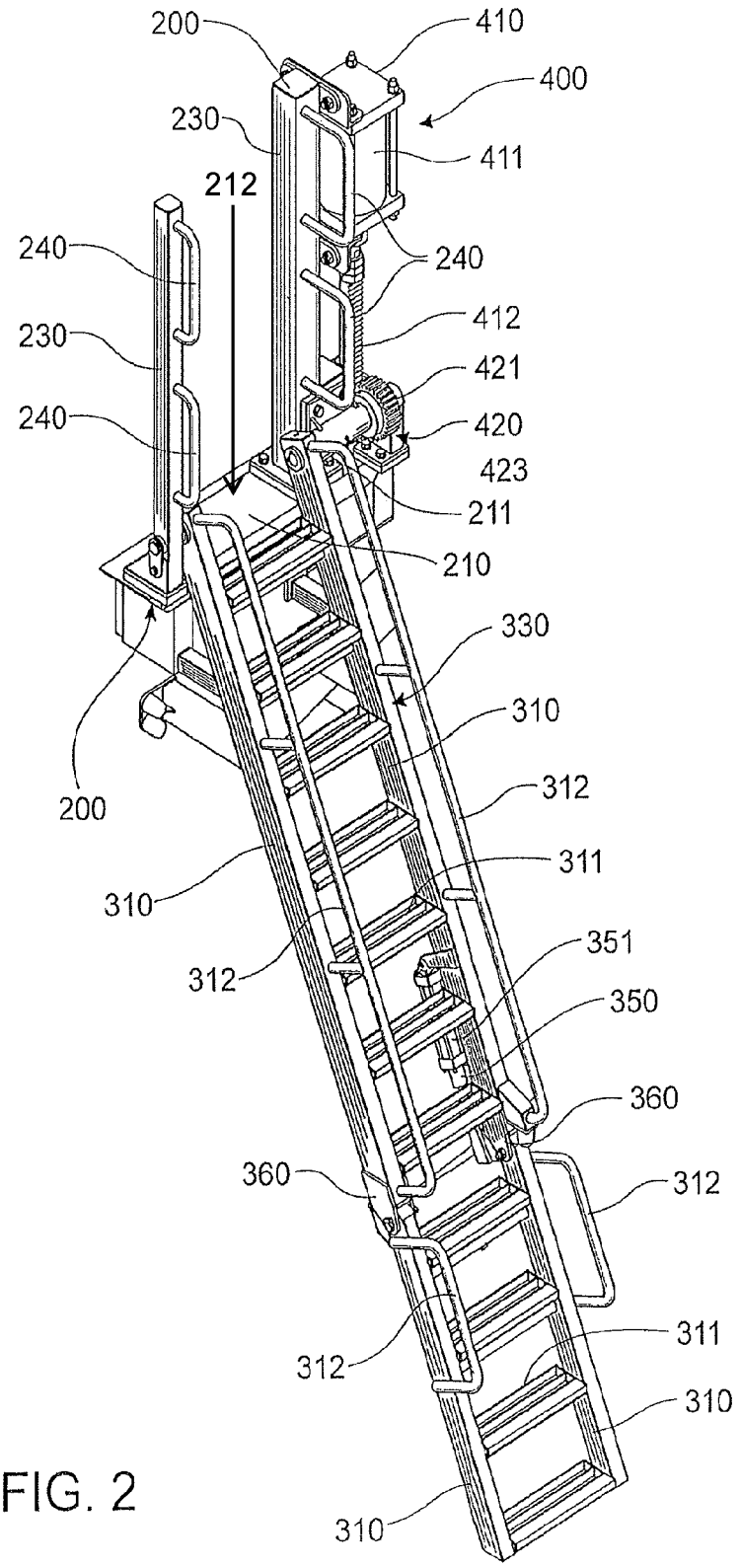
FIG. 2 is a perspective view of the ladder assembly in a deployment position as shown in FIG. 1.
Figure 4:
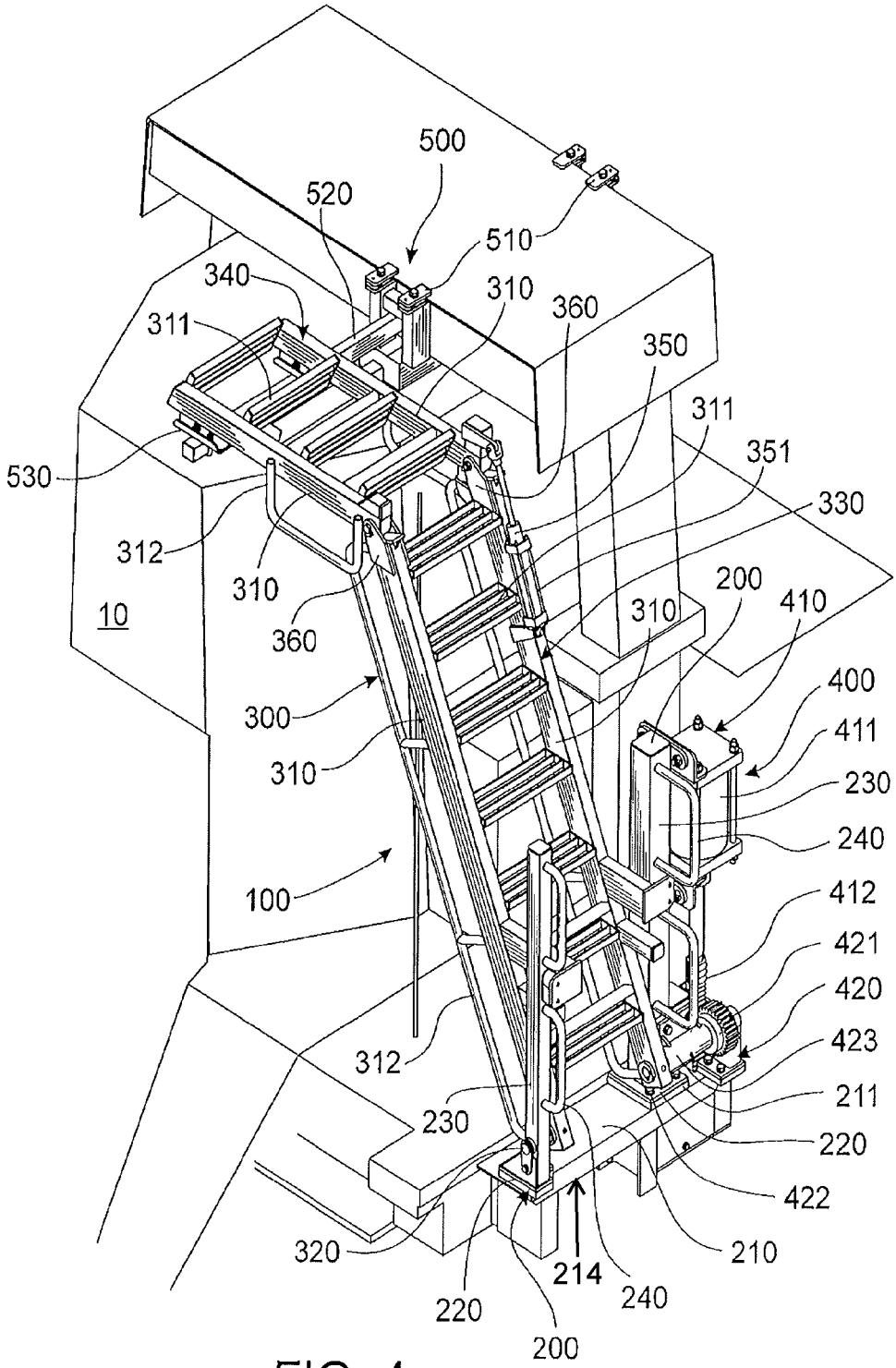
FIG. 4 is a perspective view of a bulldozer having an attached ladder assembly in a storage position as shown in FIG. 4.

The handrail mounts 200 are used to pivotally mount the ladder 300. They are also used to assist an operator when climbing up or down the ladder 300. The handrail mounts 200 are connected to a platform 210 using fasteners 211 and the platform 210 has a top side 212 as shown in FIG. 2 and a bottom side 214 located opposite with respect to the top side 212 of the platform 210 as shown in FIG. 4. One of the handrails 200 is located in front of the other of the handrails 200. Each handrail mount 200 is formed from a base 220, an upwardly extending column 230 and two handrails 240.

The ladder 300 is used to enable a person to gain access to and from the bulldozer 10. The ladder 300 includes spaced apart stiles 310 which are interconnected with a series of steps 311. Railings 312 are mounted to each of the stiles. The ladder 300 is mounted adjacent the platform 210 using the handrail mounts 200. The ladder is pivotally mounted to one of the handrail mounts 200 via a pivot pin 320.

The ladder 300 is split into a first ladder section 330 and a second ladder section 340. The first ladder section 330 is pivotally movable with respect to the second ladder section 340 using section hinges 360. A ladder actuator 350, in the form of a ladder pneumatic ram 351, is connected to both the first ladder section 330 and the second ladder section 340. The operation of the ladder actuator 350 rotates the second ladder section 340 with respect to the first ladder section 330.

The actuation mechanism 400 is used to rotate the ladder 300 between a deployment position and a storage position. The actuation mechanism includes a linear actuator 410 and a rotary actuator 420. The linear actuator 410 formed from an actuation pneumatic ram 411 that is attached to a rack 412. The pneumatic ram is attached to a handrail mount 300. The rack 412 is movable within a guide (not shown). The rotary actuator 420 is formed from a pinion 412 which is connected to a shaft 422. The pinion 421 is positioned so that pinion 421 meshes with the rack of the linear actuator. The shaft 422 is fixed to a stile 310 and the ladder 300. An axis of the shaft 422 is in alignment with an axis of the pivot pin 320 to enable the ladder to be pivotally movable. A housing 423 is used to mount the shaft via bearings (not shown). The housing 423 is fastened to a handrail mount 300 and platform 210.

The ladder support 500 is mounted to a top of the bulldozer 10. The ladder support includes an attachment portion 510 which is used to attach the ladder support to the roof of a bulldozer and a support arm 520 which is used to support the ladder 300 when the ladder assembly 100 is in the storage position. Two alignment members 530 are located on the support arm 520 to align, position and hold the ladder 300 during operation of the bulldozer 10.

Figure 3:
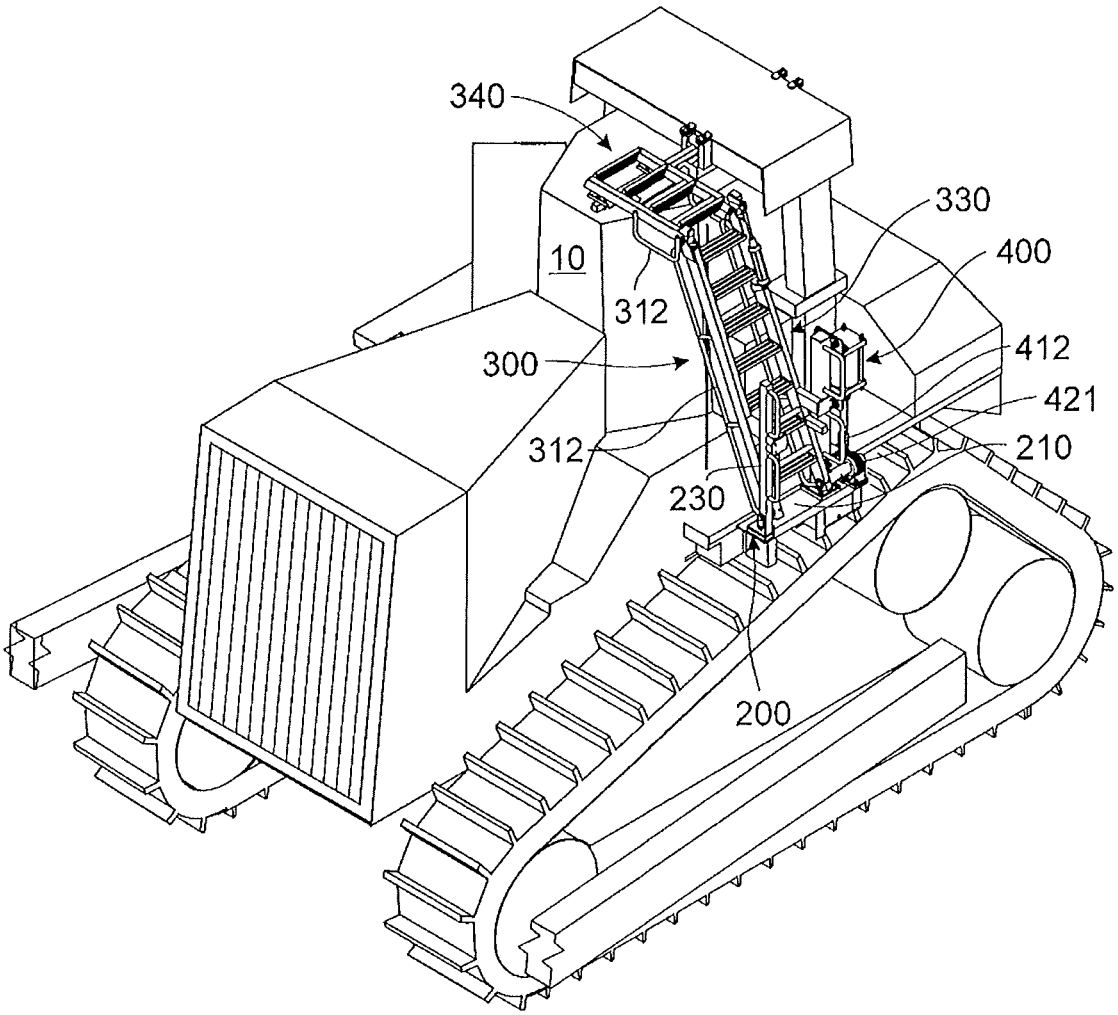
FIG. 3 is a perspective view of bulldozer having an attached ladder assembly in a storage position according to an embodiment of the invention.

In use the ladder assembly 100 is movable between a deployment position, as shown in FIGS. 1 and 2, and a storage position, as shown in FIGS. 3 and 4. The deployment position allows an operator to move to and from the bulldozer using the ladder 300. The storage position allows the operation of the bulldozer without impediment of the ladder 300.

In order to move the ladder assembly 100 from the deployment position to the storage position, a pilot valve (not shown) must be activated. This is normally activated by releasing of a handbrake of the bulldozer. However, it would be appreciated by a person skilled in the art that the pilot valve may be activated using some other activation source such as the ignition of the bulldozer.

Once the pilot valve is activated, air is supplied to the ladder pneumatic ram 351 and the actuation pneumatic ram 411. The ladder pneumatic ram 351 causes the second ladder section 330 to rotate with respect to the first ladder section 330 inclining the second ladder section 340 with respect to the first ladder section 330.

The actuation pneumatic ram 411 extends moving the rack 412 downwardly with respect to the handrail mounts 200. This causes the rack 412 to rotate the pinion 412 which in turn causes rotation of the shaft 422. As the ladder 300 is pivotally mounted by the shaft 422 and the pivot pin 320, the ladder 300 is caused to rotate with respect to the handrail mounts 200. The ladder 300 is rotated until the second ladder section 340 engages with the alignment members 530 located on the support arm 520 of the ladder support 510.

In order to move the ladder 300 from the deployment position to the storage position, the handbrake is engaged to activate the pilot valve. This causes air to be supplied to the ladder pneumatic ram 351 and the actuation pneumatic ram 411.

The ladder pneumatic ram 351 causes the second ladder section 330 to rotate with respect to the first ladder section 330 straightening the second ladder section 340 with respect to the first ladder section 330.

The actuation pneumatic ram 411 extends moving the rack 412 upwardly with respect to the handrail mounts 200. This causes the rack 412 to rotate the pinion 421 which in turn causes rotation of the shaft 422. As the ladder 300 is pivotally mounted by the shaft 422 and the pivot pin 320, the ladder 300 is caused to rotate with respect to the handrail mounts 200. The ladder 300 is rotated until the second ladder section 340 engages with the ground.

It should be appreciated that timing of the activation of the ladder pneumatic ram and the actuation pneumatic ram may be varied according to design. The ladder assembly 100 provides a straight forward yet effect way in which an operator can gain access to an equipment yet the ladder assembly does not inhibit use of the equipment. This is largely due to the fact that the ladder can be rotated through a large range of motion that is not provided by prior art ladders that are connected solely to a ram.

FIGS. 5 to 8 show further examples of the ladder assembly 100 mounted to earthmoving equipment 20,30. The reference numerals used for the ladder assembly 100 in FIGS. 5 to 8 are the same as those used in FIGS. 1 to 4.

Figure 5:
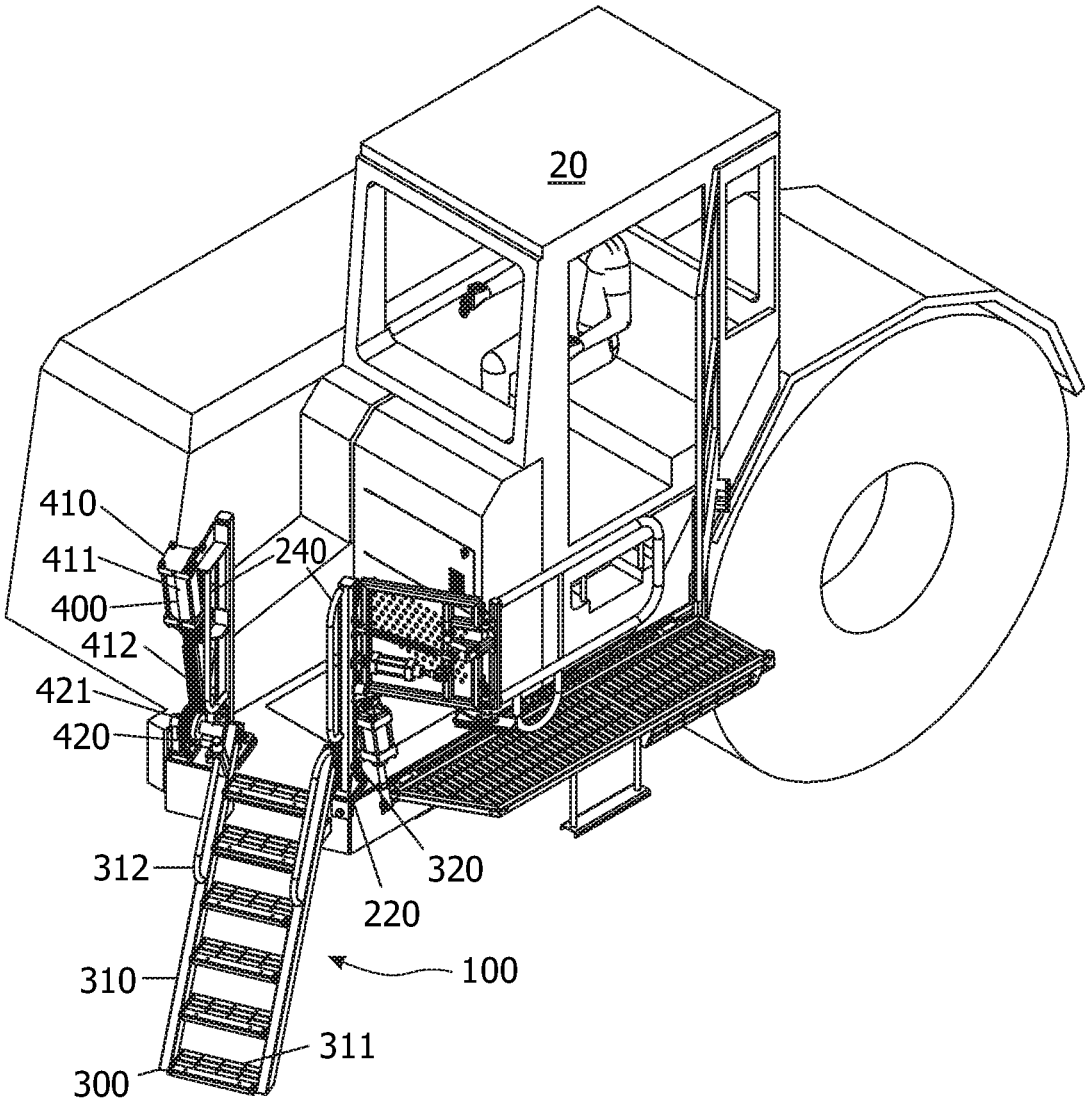
FIG. 5 is a perspective view of earthmoving equipment having an attached ladder assembly in a deployment position according to an embodiment of the invention.
Figure 6:
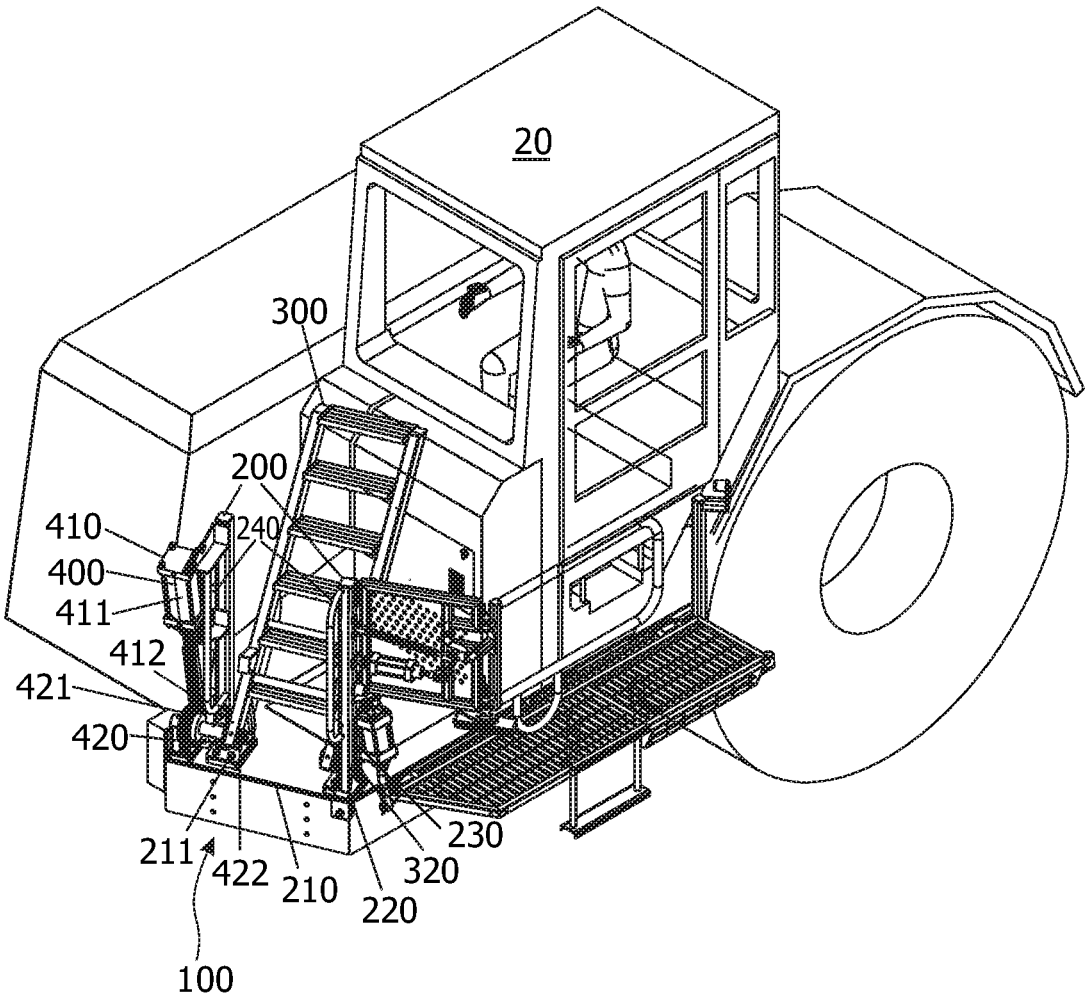
FIG. 6 is a perspective view of earthmoving equipment having an attached ladder assembly in a storage position according to an embodiment of the invention.
Figure 7:
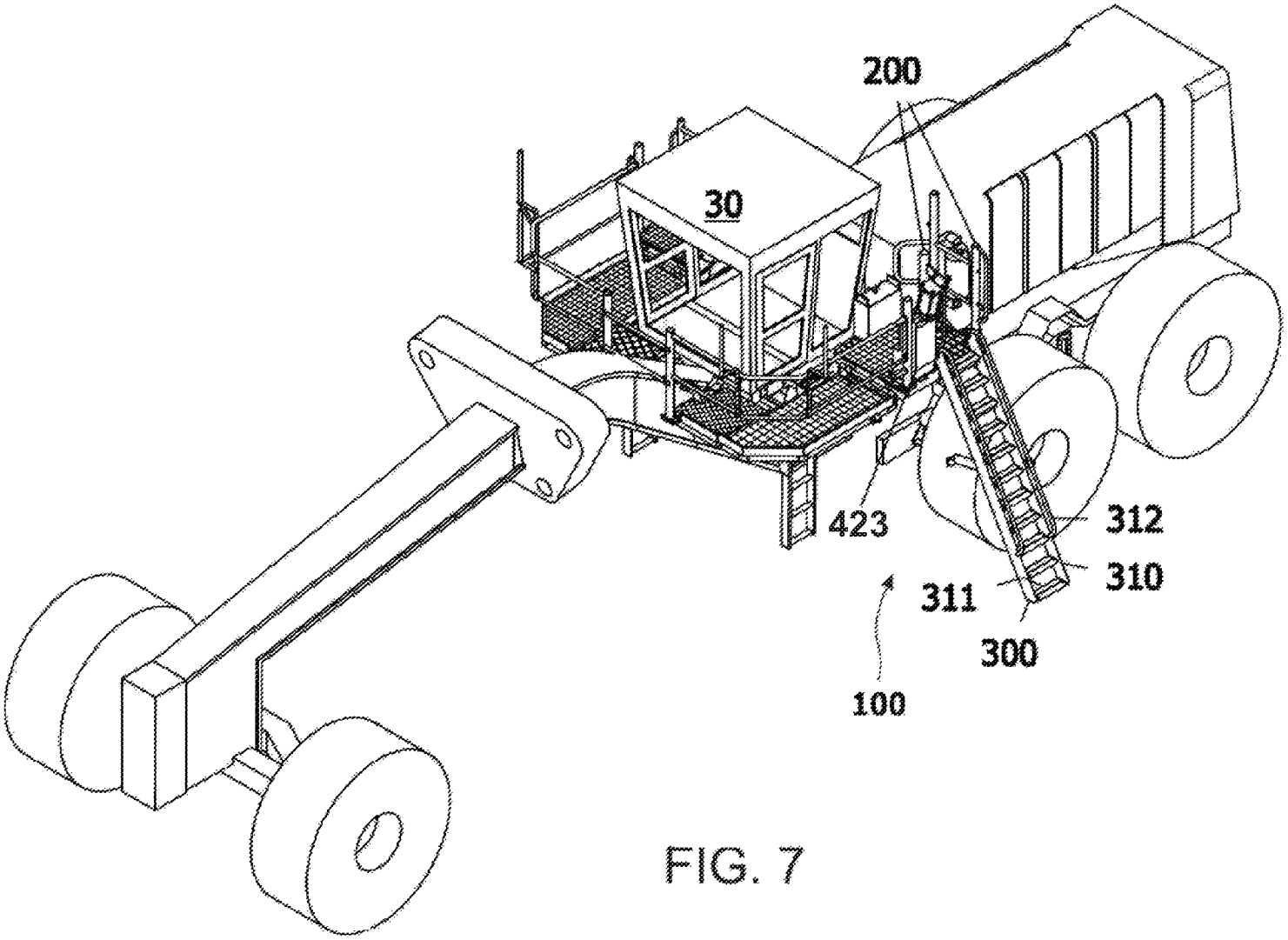
FIG. 7 is a perspective view of earthmoving equipment having an attached ladder assembly in a deployment position according to an embodiment of the invention.
Figure 8:
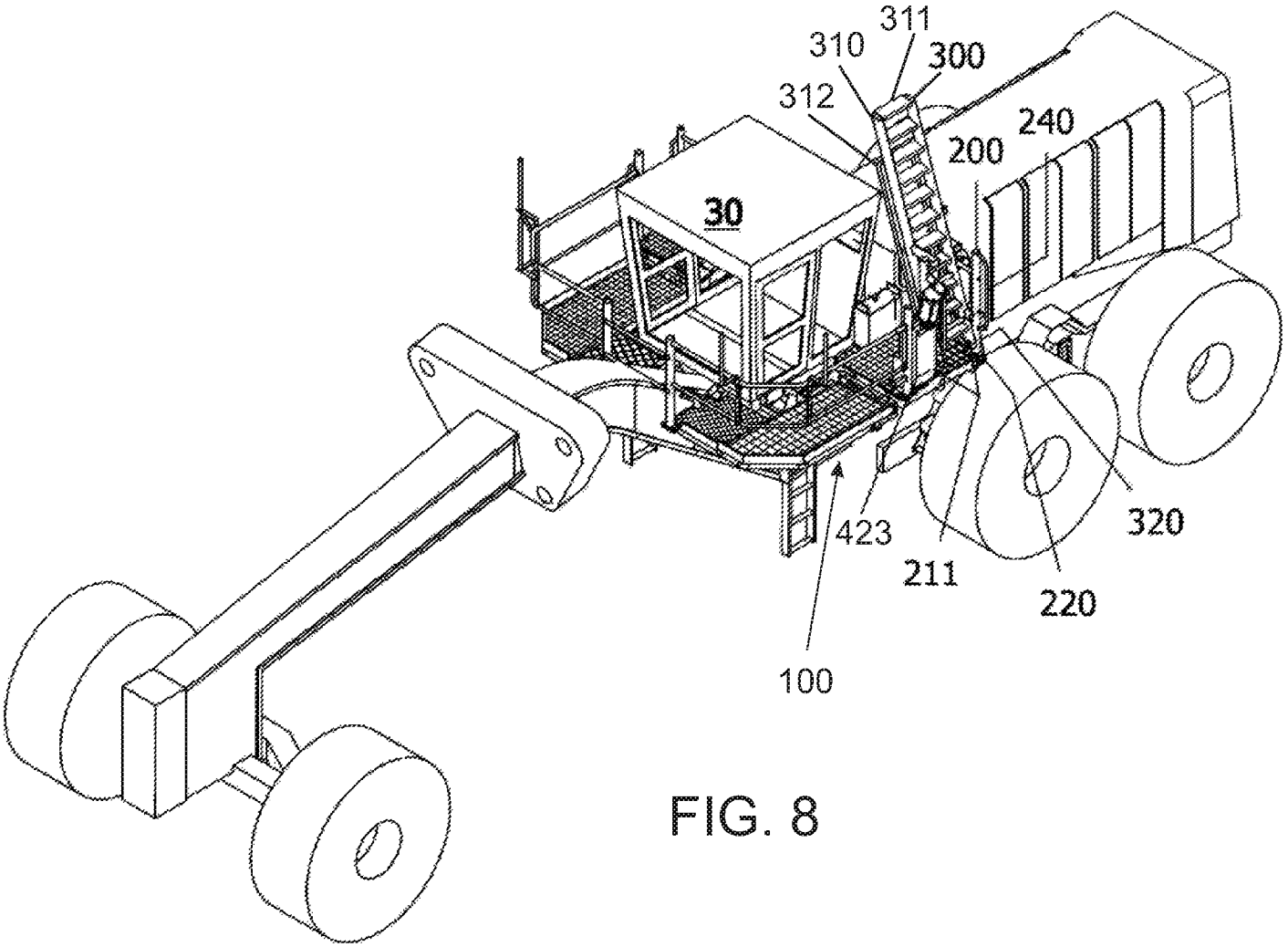
FIG. 8 is a perspective view of earthmoving equipment having an attached ladder assembly in a storage position according to an embodiment of the invention.

FIGS. 5 and 7 show the ladder assembly 100 in a deployment position, and FIGS. 6 and 8 show the ladder assembly 100 in a storage position. The deployment position allows an operator to move to and from the earthmoving equipment 20,30 using the ladder 300. The storage position allows the operation of the earthmoving equipment without impediment of the ladder 300.

In this Specification, the terms "comprise", "comprises", "comprising" or similar terms are intended to mean a non-exclusive inclusion, such that a system, method or apparatus that comprises a list of elements does not include those elements solely, but may well include other elements not listed.

It will also be appreciated that various other changes and modifications may be made to the embodiment described without departing from the spirit and scope of the invention.

The invention claimed is:

1. A ladder assembly for a vehicle, the ladder assembly comprising:

a platform having a thickness defined between a top side of the platform and an opposite bottom side of the platform;

a ladder pivotally mounted adjacent the platform via mounts, wherein the ladder is rotatable between a deployment position and a storage position, the ladder has a length defined between a first end of the ladder and an opposite second end of the ladder, and, when the ladder is in the deployment position, the first end of the ladder extends above the top side of the platform and the opposite second end of the ladder extends below the opposite bottom side of the platform;

an actuation mechanism comprising a drive configured for linear movement from a first position to a second position;

a rotational actuator operatively connected to the ladder, wherein the drive of the actuation mechanism engages the rotational actuator such that linear movement of the drive from the first position to the second position rotates the rotational actuator to pivot the ladder about the mounts; and a ladder support mountable to a top of the vehicle and comprising an attachment portion for attaching the ladder support to a roof of the vehicle, a support arm for supporting the ladder when the ladder is disposed in the storage position, and alignment members located on the support arm for aligning and holding the ladder during operation of the vehicle such that, when the ladder is disposed in the storage position, a portion of the ladder engages the alignment members located on the support arm of the ladder support that is mountable to the top of the vehicle wherein the rotational actuator includes a shaft, the ladder is pivotally mounted to the mounts and connected to the mounts via a pivot pin, and an axis of the shaft and an axis of the pivot pin are in alignment.

2. The ladder assembly of claim 1, wherein the drive is a linear actuator and a portion of the linear actuator is attached to a portion of the rotational actuator.

3. The ladder assembly of claim 2, wherein the linear actuator includes a ram.

4. The ladder assembly of claim 3, wherein the ram is a pneumatic ram or a hydraulic ram.

5. The ladder assembly of claim 2, wherein the linear actuator further includes a rack.

6. The ladder assembly of claim 1, wherein the rotational actuator is directly attached to the ladder.

7. The ladder assembly of claim 1, wherein the shaft is rotatable when the drive of the actuation mechanism moves from the first position to the second position.

8. The ladder assembly of claim 1, wherein the linear movement of the drive rotates the shaft.

9. The ladder assembly of claim 1, wherein the shaft is attached to a rotational member.

10. The ladder assembly of claim 9, wherein the rotation member is attached to a portion of the actuation mechanism.

11. The ladder assembly of claim 10, wherein the rotation member is selected from the group consisting of a lever, a pulley or gear, a cog and a pinion.

12. The ladder assembly of claim 1, wherein the shaft is directly attached to the ladder.

13. The ladder assembly of claim 1, wherein the ladder has a first ladder section that is pivotally movable with respect to a second ladder section of the ladder.

14. A ladder assembly for a vehicle, the ladder assembly comprising:

a mount comprising a platform, wherein the platform has an entire height defined between a top side of the platform and an opposite bottom side of the platform;

a ladder pivotally mounted to the mount, wherein the ladder has an entire length defined between a first end of the ladder and an opposite second end of the ladder and is movable between a deployment position and a storage position;

a rotational actuator operatively connected to the ladder and including a shaft;

an actuation mechanism comprising a drive that engages the rotational actuator; and a ladder support mountable to a top of the vehicle and comprising an attachment portion for attaching the ladder support to a roof of the vehicle, a support arm for supporting the ladder when the ladder is disposed in the storage position, and alignment members located on the support arm for aligning and holding the ladder during operation of the vehicle such that, when the ladder is disposed in the storage position, a portion or section of the ladder engages the alignment members located on the support arm of the ladder support that is mountable to the top of the vehicle, wherein movement of the drive rotates the rotational actuator and pivots the ladder to the deployment position or the storage position at least one selected from the rotational actuator and the actuation mechanism is disposed on the top side of the platform, the ladder is pivotally mounted to the mount and connected to the mount via a pivot pin, and an axis of the shaft and an axis of the pivot pin are in alignment.

15. A ladder assembly for a vehicle, the ladder assembly comprising:

a mount comprising a platform, wherein the platform has an entire height defined between opposing top and bottom surfaces of the platform;

a ladder pivotally mounted to the mount, wherein the ladder has an entire length defined between opposing ends of the ladder and is movable to a first position such that the opposing ends of the ladder extend outwardly away from the opposing top and bottom surfaces of the platform;

a rotational actuator operatively connected to the ladder and including a shaft;

a linear actuator engaging the rotational actuator; and a ladder support mountable to a top of the vehicle and comprising an attachment portion for attaching the ladder support to a roof of the vehicle, a support arm for supporting the ladder when the ladder is disposed in a storage position, and alignment members located on the support arm for aligning and holding the ladder during operation of the vehicle such that, when the ladder is disposed in the storage position, a portion or section of the ladder engages the alignment members located on the support arm of the ladder support that is mountable to the top of the vehicle, wherein at least one of the rotational actuator and the linear actuator is disposed on the top surface of the platform, the ladder is pivotally mounted to the mount and connected to the mount via a pivot pin, and an axis of the shaft and an axis of the pivot pin are in alignment.

* * * * *